US010348037B2

(12) United States Patent
Ilie

(10) Patent No.: US 10,348,037 B2
(45) Date of Patent: Jul. 9, 2019

(54) ELECTRICAL CONNECTOR COMPRISING A PLURALITY OF ELECTRICALLY CONDUCTIVE STRIPS

(71) Applicant: Razvan Ilie, Rocquencourt (FR)

(72) Inventor: Razvan Ilie, Rocquencourt (FR)

( * ) Notice: Subject to any disclaimer, the term of this patent is extended or adjusted under 35 U.S.C. 154(b) by 0 days.

(21) Appl. No.: 15/434,940

(22) Filed: Feb. 16, 2017

(65) Prior Publication Data

US 2017/0244196 A1 Aug. 24, 2017

(30) Foreign Application Priority Data

Feb. 18, 2016 (FR) ..... 16 51321

(51) Int. Cl.

| | |
|---|---|
| ***H01R 13/18*** | (2006.01) |
| ***H01R 13/631*** | (2006.01) |
| ***H01R 13/533*** | (2006.01) |
| ***H01R 13/11*** | (2006.01) |
| ***H01R 13/44*** | (2006.01) |
| ***H01R 13/24*** | (2006.01) |

(52) U.S. Cl.

CPC ..... *H01R 13/631* (2013.01); *H01R 13/111* (2013.01); *H01R 13/18* (2013.01); *H01R 13/2457* (2013.01); *H01R 13/44* (2013.01)

(58) Field of Classification Search

CPC .... H01R 13/111; H01R 13/18; H01R 13/187; H01R 13/11; H01R 13/426; H01R 13/44; H01R 13/502; H01R 24/38; H01R 4/183

USPC ..... 439/851, 843, 638, 654, 748, 816, 839

See application file for complete search history.

(56) References Cited

U.S. PATENT DOCUMENTS

| | | | | |
|---|---|---|---|---|
| 5,588,852 | A | 12/1996 | Puerner | |
| 6,042,432 | A | 3/2000 | Hashizawa et al. | |
| 6,827,608 | B2 * | 12/2004 | Hall | H01R 13/6315 439/578 |

(Continued)

FOREIGN PATENT DOCUMENTS

JP 2009054374 3/2009

OTHER PUBLICATIONS

Preliminary Search Report for FR 1651321, completed Oct. 27, 2016.

*Primary Examiner* — Amy Cohen Johnson
*Assistant Examiner* — Matthew T Dzierzynski
(74) *Attorney, Agent, or Firm* — B. Aaron Schulman, Esq.; Stites & Harbison, PLLC

(57) ABSTRACT

An electrical connector (1) including a male contact (5) and a female contact (10) movable between a non-inserted position, and an inserted position, wherein an electrically conductive insertable portion (12) of the male contact (5) is inserted along an insertion axis (D) into a housing (14) defined by the female contact, the female contact including: an electrically conductive body (22), a plurality of strips (26) protruding axially from the body and angularly distributed around the insertable portion in the inserted position, the strips being electrically conductive and radially flexible, the body and the strips defining the housing, and at least one annular contention member (28) positioned on radially external faces (30) of the strips and adapted for exerting a centripetal radial pressure on the strips in the inserted position, the strips having radially internal faces (42) flattened against the insertable portion in the inserted position.

16 Claims, 2 Drawing Sheets

(56) References Cited

U.S. PATENT DOCUMENTS

| | | | | |
|---|---|---|---|---|
| 6,899,572 | B1 * | 5/2005 | Baker | H01R 13/111 439/181 |
| 7,467,980 | B2 * | 12/2008 | Chiu | H01R 13/18 439/843 |
| 7,789,721 | B1 * | 9/2010 | Burdenko | H01R 13/111 439/851 |
| 8,317,552 | B2 * | 11/2012 | Leroyer | H01R 13/111 439/839 |
| 9,009,960 | B2 * | 4/2015 | Vaccaro | H01R 13/111 29/874 |
| 9,431,741 | B2 * | 8/2016 | Takahashi | H01R 13/187 |
| 9,601,856 | B2 * | 3/2017 | Regantini | H02B 11/04 |
| 9,761,983 | B2 * | 9/2017 | Mott | H01R 13/426 |
| 9,787,012 | B2 * | 10/2017 | Kawaguchi | H01R 13/111 |
| 9,917,399 | B2 * | 3/2018 | Gessford | H01R 13/6271 |
| 2008/0242151 | A1 | 10/2008 | Chiu | |
| 2012/0052750 | A1 | 3/2012 | Leroyer et al. | |
| 2016/0028169 | A1 | 1/2016 | Glick et al. | |

* cited by examiner

ELECTRICAL CONNECTOR COMPRISING A PLURALITY OF ELECTRICALLY CONDUCTIVE STRIPS

BACKGROUND OF THE INVENTION

Field of the Invention

The present invention relates to an electrical connector including a male contact and a female contact movable between a non-inserted position, in which the male contact is away from the female contact, and an inserted position, in which an electrically conductive insertable portion of the male contact is inserted along an insertion axis into a housing defined by the female contact.

The electrical connector is for example a power connector, i.e. it is suitable for transmitting a current with an intensity greater than or equal to 10 A.

Description of Related Art

Presently two categories of these electrical connectors are known. A first category encompasses connectors having an interface intended to guarantee a good contact surface area. The interface is usually made from wires or an embossed plate in order to create the adequate shape. This category has the advantage of having low insertion forces and good resistance to vibrations. However, the number of parts used for making the interface is relatively high, and the space occupied by the interface generates congestion. Further, this type of connector is of a relatively high price.

In the second category, the electrical contact is ensured by the pressure of both contacts, which has to be high, in order to compensate for a small contact surface area. These connectors have a lower manufacturing cost but also high insertion forces and a lower resistance to vibrations and to fretting, i.e. to the wear of the contact which affects the contacting surfaces of the male contact and of the female contact.

BRIEF SUMMARY OF THE INVENTION

An object of the invention is therefore to provide an electrical connector having a reasonable insertion force, good resistance to vibrations and low bulkiness relatively to its electric performances, while remaining with a simple manufacturing and of a competitive price.

For this purpose, the object of the invention is an electrical connector including a male contact and a female contact movable between a non-inserted position, in which the male contact is away from the female contact, and an inserted position, in which an electrically conductive insertable portion of the male contact is inserted along an insertion axis in a housing defined by the female contact, the female contact including:

- an electrically conductive body,
- a plurality of strips protruding axially from the body and angularly distributed around the insertable portion in the inserted position, the strips being electrically conductive and radially flexible, the body and the strips defining said housing, and
- at least one annular contention member positioned on radially external faces of the strips and adapted for exerting a centripetal radial pressure on the strips in the inserted position, the strips having radially internal faces flattened against the insertable portion in the inserted position.

According to particular embodiments of the invention, the electrical connector comprises one or several of the following features, taken individually or according to all the technically possible combinations:

- the insertable portion comprises at least one contact portion on which the strips are flattened in the inserted position, the contact portion including a proximal end having a proximal diameter, the strips defining a distal opening of the housing, the distal opening having a first diameter in the non-inserted position, and a second diameter greater in the inserted position, the first opening diameter being strictly less than the proximal diameter, and the second opening diameter being substantially equal to the proximal diameter;
- the contact portion includes a distal end having a distal diameter, the strips defining a bottom of the housing, the bottom having an opening diameter of less than or equal to the distal diameter, preferably less than the distal diameter;
- the first opening diameter is less than or equal to, preferably less than, the distal diameter, the insertable portion further comprising a distal portion which is radially thinner than the distal diameter so as to be introduced into the opening of the housing;
- the contact portion includes a radially outer cylindrical or frustoconical surface;
- the contention member comprises a strip curved with a «C» shape, the strip preferably passing in circumferential grooves formed by the radially outer faces of the strips;
- the connector further comprises a first electrical insulator adapted so as to be inserted into the housing of the female contact in order to protect a user of the electrical connector, the first insulator comprising:
  - a ring adapted for capping the distal ends of the strips, and
  - ties extending axially from the ring and provided for being inserted between the strips in order to attach the first insulator on the female contact;
- the first insulator further comprises:
  - a base located axially opposite to the ring, and
  - a finger extending axially from the base to the ring, the finger being substantially located at the center of the housing with view to being along the insertion axis;
- each tie forms a bar attached on the base and substantially oriented axially; and
- the connector further comprises a second electrical insulator adapted for covering a distal end of the insertable portion, the second electrical insulator being adapted so as to be attached on this distal end, preferably by insertion of a rod of the second insulator along the insertion axis into the insertable portion.

BRIEF DESCRIPTION OF THE SEVERAL VIEWS OF THE DRAWINGS

The invention will be understood upon reading the description which follows, only given as an example and made with reference to the appended drawings wherein.

DETAILED DESCRIPTION OF THE INVENTION

Figure 1:
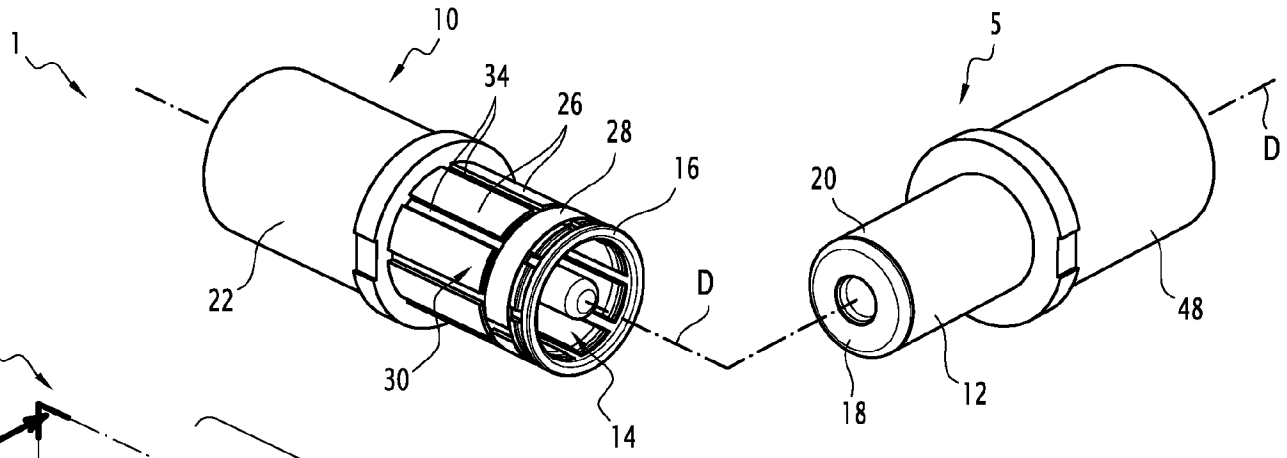
FIG. 1 is a perspective view of an electrical connector according to the invention in the non-inserted position.
Figure 2:
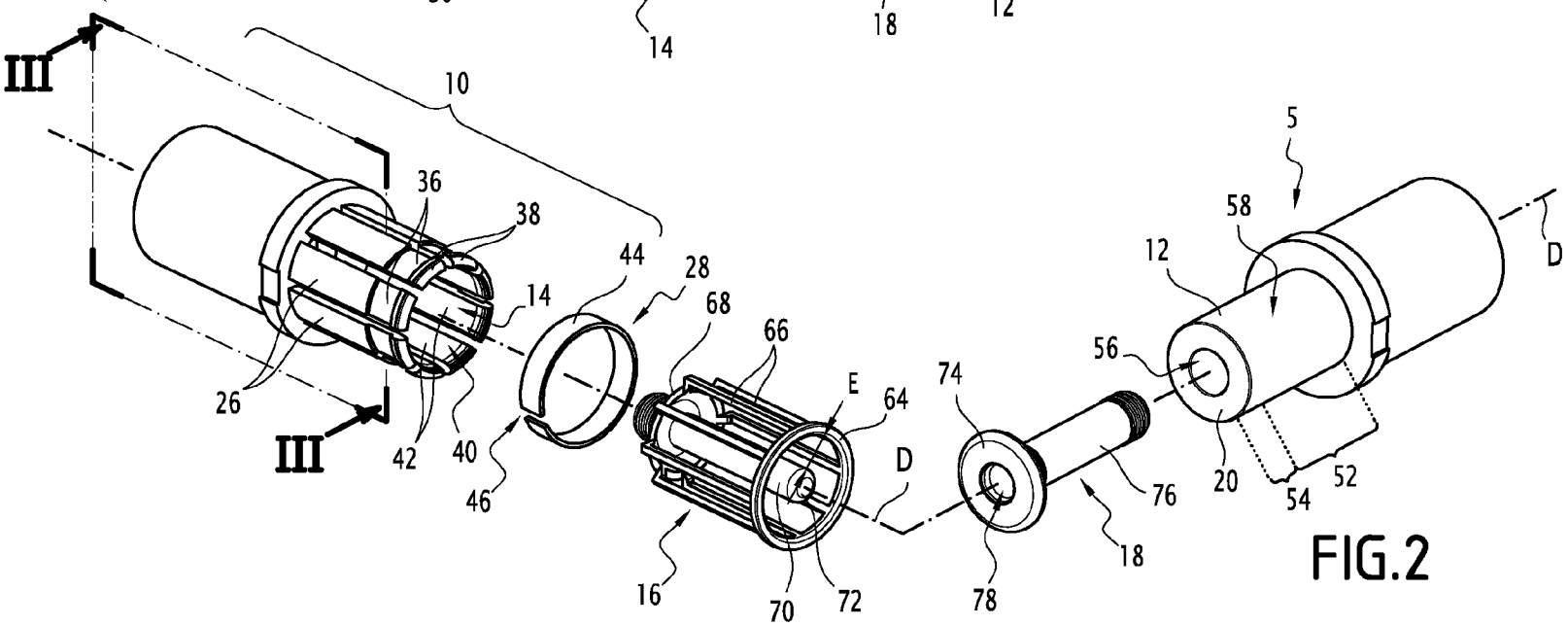
FIG. 2 is a view of the connector illustrated in FIG. 1, exploded along the insertion axis.
Figure 3:
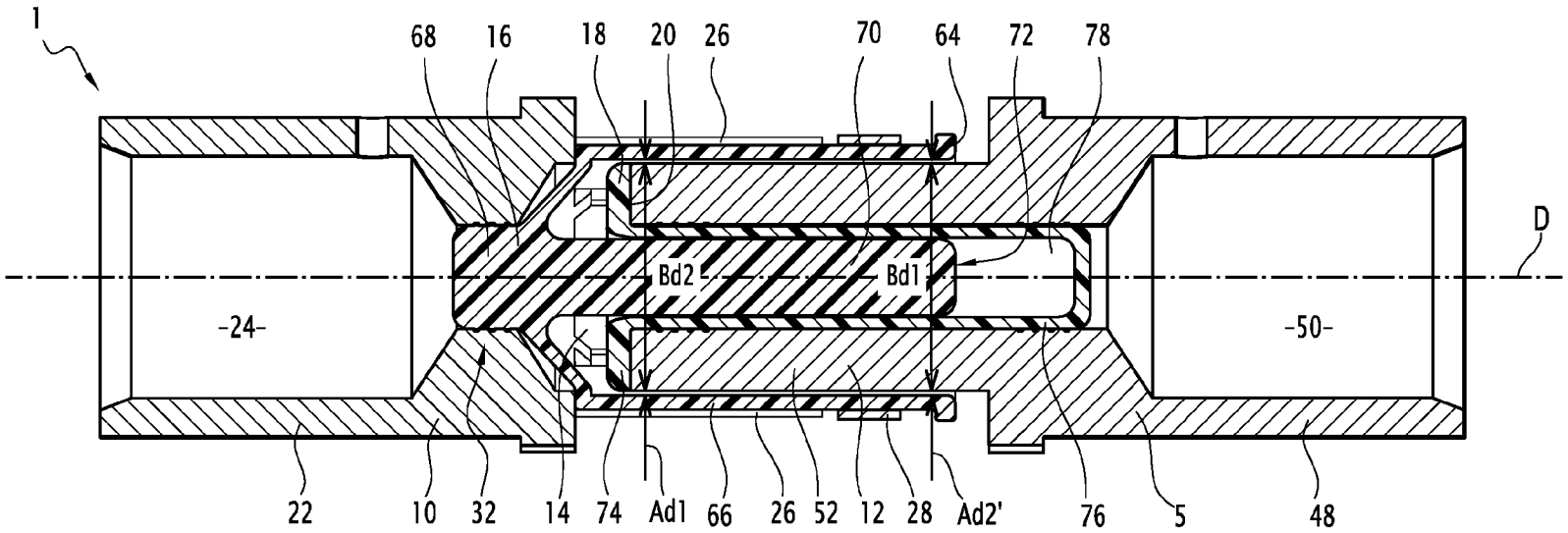
FIG. 3 is a view of the electrical connector illustrated in FIGS. 1 and 2, in a sectional view along a plane passing through the insertion axis, the electrical connector being in the inserted position.

With reference to FIGS. 1 to 3, an electrical connector 1 according to the invention is described.

The electrical connector 1 comprises a male contact 5 and a female contact 10 movable between a non-inserted position (FIG. 1), in which the male contact is away from the female contact, and an inserted position (FIG. 3) in which an electrically conductive insertable portion 12 of the male contact is inserted along an insertion axis D into a housing 14 defined by the female contact.

The electrical connector 1 advantageously comprises a first electrical insulator 16 adapted so as to be inserted into the housing 14 for protecting a user (not shown) of the electrical connector. Also, advantageously, the electrical connector 1 comprises a second electrical insulator 18 adapted for covering a distal end 20 of the insertable portion 12 of the male contact 5.

By «distal», is meant for each of the contacts, the side defined by the insertion direction along the insertion axis D. Correlatively, by «proximal» is meant the side opposite to the insertion along the insertion axis D.

The electrical connector 1 further comprises advantageously insulating sheaths (not shown) respectively surrounding the male contact 5 and the female contact 10 around the insertion axis D for protecting these contacts from any lateral electrical contact, notably with an operator (not shown). The insulating sheaths are obviously adapted so as not to oppose the insertion of the male contact 5 into the female contact 10 and for ensuring protection both in the non-inserted position and the inserted position.

The male contact 5 and the female contact 10 are intended to be put into electrical contact with at least two electrical cables (not shown).

The female contact comprises an electrically conductive body 22 and for example defining a housing 24 (FIG. 3) for one of the electrical cables.

In the sense of the present application, by «conductor» is meant a material for which the electrical resistivity at 300 K is for example less than or equal to $10^{-5}$ Ω·m. On the contrary, by "insulator" is meant a material for which the electric resistivity at 300 K is for example greater than or equal to $10^{5}$ Ω·m.

The female contact 10 further comprises a plurality of strips 26 protruding axially from the body 22 and angularly distributed around the insertable portion 12 in the inserted position, and an annular contention member 28 positioned on radially external faces of the strips 26.

The body 22 defines a bottom 32 of the housing 14, for example with a cylindrical shape and wherein the first insulator 16 is inserted.

The strips 26 are at least two in number. In the illustrated example, the strips 26 are eight in number. The strips 26 radially delimit the housing 14.

The strips 26 are advantageously identical with each other and distributed regularly around the insertion axis D. Two angularly consecutive strips 26 are advantageously separated by a slot 34.

The strips 26 define circumferential grooves 36 aligned with each other and adapted for receiving the contention member 28.

The strips 26 are radially flexible, i.e. their distal ends 38 may approach or move away radially from the insertion axis D.

The strips 26 define, at the bottom of the housing 14, an opening diameter Ad1.

In the non-inserted position, the strips 26 are for example slightly bent towards the insertion axis D gradually as their ends 38 are approached.

Figure 4:
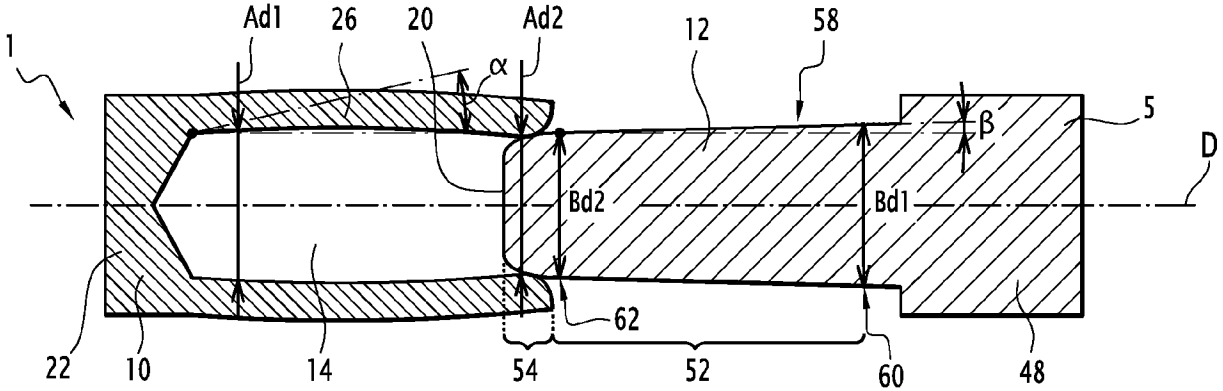
FIG. 4 is a simplified view of the connector illustrated in FIGS. 1 to 3, in a sectional view along the plane, the electrical connector being right at the beginning of an insertion phase.

According to a particular embodiment, the strips 26 form at their base an angle a with the insertion axis D, as illustrated in FIG. 4. The angle a is for example comprised between 0° and 4°.

As the strips 26 and the contention member 28 are flexible, the distal ends 38 define a distal opening 40 of the housing 14 having a first diameter Ad2 in the non-inserted position, and a second diameter Ad2' in the inserted position.

In the non-inserted position, the slots 34 for example have a length along the insertion axis D, comprised between 5 mm and 80 mm, and a width, in the circumferential direction, comprised between 0.2 mm and 2.5 mm.

In the inserted position, the strips 26 have radially internal faces 42 flattened against the insertable portion 12.

The second diameter Ad2' is greater than the first diameter Ad2.

The opening diameter Ad1 of the bottom of the housing 14 is advantageously greater than or equal to the first diameter Ad2 of the distal opening 40.

The contention member 28 is adapted for exerting a centripetal radial pressure on the strips 26 in the inserted position.

The contention member 28 for example comprises a strip 44 (FIG. 2) bent around the insertion axis D and having a «C» shape. The contention member 28 advantageously forms a ring having an interruption 46.

The interruption 46 for example has a measurement between 0.1 mm and 3 mm in the circumferential direction. The switch 46 is able to give the contention member 28 elasticity adapted for maintaining the strips 26 flattened onto the contact portion 52.

For example, the strips 26 are in aluminium, copper, brass. The contention member 28 is for example in steel.

The thickness of the strips for example is 2 mm.

The male contact 5 includes an electrically conductive body 48 and advantageously defining a housing 50 provided for receiving one of the electrical cables.

The insertable portion 12 protrudes axially from the body 48.

The insertable portion 12 comprises a contact portion 52 adapted so as to be in contact with the strips 26 in the inserted position, and a distal portion 54 including the distal end 20 already mentioned above.

Advantageously, the insertable portion 12 also comprises an axial housing 56 opening onto the distal end 20 and adapted for receiving the second insulator 18 (FIGS. 2 and 3).

The contact portion 52 includes a cylindrical radially external surface 58.

Alternatively (not shown), the radially external surface 58 is frustoconical.

The contact portion 52 includes a proximal end 60 having a proximal diameter Bd1, and a distal end 62 having a distal diameter Bd2. Bd1 and Bd2 are equal in the illustrated example.

According to a particular embodiment (FIG. 4), the radially external surface 58 forms, at its distal end 62, an angle β with the insertion axis D. The angle β is less than or equal to the angle α of the strips 26.

In the inserted position, the angle α and the angle β are substantially equal.

The first opening diameter Ad2 is strictly smaller than the proximal diameter Bd1.

The second opening diameter Ad2' is substantially equal to the proximal diameter Bd1.

The opening diameter Ad1 of the bottom of the housing 14 is less than or equal to the diameter distal Bd2, preferably strictly less by at least 0.01 mm to the distal diameter Bd2.

Preferably, the first opening diameter Ad2 is less than or equal to, preferably strictly less, than the distal diameter Bd2.

The distal portion 54 is radially thinner than the distal diameter Bd2, so as to be easily introduced into the distal opening 40 of the housing 14.

As visible in FIG. 2, the first insulator 16 comprises a ring 64 adapted for capping the distal ends 38 of the strips 26, and ties 66 extending axially from the ring and provided so as to be inserted into the slots 34 between the strips 26 for attaching the first insulator onto the female contact 10. The first insulator 16 further comprises a base 68 axially located opposite to the ring 64, and a finger 70 extending axially from the base to the ring.

The ties 66 advantageously form bars attached on the base 68 and oriented substantially axially. The first insulator 16 thus has the aspect of a cylindrical cage.

The finger 70 is substantially located at the center of the housing 14 with view to being along the insertion axis D when the first insulator 16 is inserted into the housing. The finger 70 includes a distal end 72 substantially located at the center of the ring 64. The finger 70 is for example substantially cylindrical.

The finger 70 and the ring 64 define a radial deviation E advantageously less than or equal to 3 mm so as to prevent an operator (not shown) from introducing his/her finger into the housing 14 between the finger 70 and the strips 26.

The second insulator 18 (FIGS. 2 and 3) includes a head 74 and a rod 76 adapted so as to be introduced into the housing 56 of the male contact 5. The second insulator 18 defines a housing 78 extending axially and opening onto the head 74.

The housing 78 is adapted for receiving the finger 70 of the first insulator 16 into the inserted position of the electrical connector 1.

The operation of the connector 1 is inferred from its structure and will be described hereafter.

When the electrical connector 1 is in operation, the electrical cables (not shown) mentioned earlier are received in the housings 24 and 50.

The first insulator 16 and the second insulator 18 were inserted beforehand respectively into the female contact 10 and the male contact 5 along the insertion axis D.

To do this, the ties 66 are inserted into the slots 34 until the ring 64 masks the distal ends 38 of the strips 26. The base 68 is then attached in the body 22 by jamming, or alternatively by snap-on fastening.

In order to instal the second electrical insulator 18, the rod 76 is introduced into the housing 56 of the insertable portion 12 along the insertion axis D, until the head 74 covers the distal end 20.

The electrical connector 1 is then ready-for-use.

It is recalled that the external sheaths (not shown) protect the operator against any untimely contact in the radial direction with the male contact 5 or the female contact 10.

The first electrical insulator 16 protects distal ends 38 from the female contact 10. The ring 64 and the finger 70 cooperate in order to prevent the operator from introducing his/her finger into the housing 14. However, by its cage-shaped structure, the first electrical insulator 16 does not prevent electrical contact between the strips 26 and the radially external surface 58 of the contact portion 52 of the insertable portion 12.

Also, the second electrical insulator 18 prevents the operator from touching the distal end 20 of the insertable portion 12.

The electrical contact 1 is then in the non-inserted position illustrated in FIG. 1.

The male contact 5 is then inserted into the housing 14 along the insertion axis D.

The distal portion 54 of the insertable portion 12 (FIG. 4) crosses the distal opening 40 of the housing 14. The distal ends 38 of the strips 26 will then come into contact with the distal portion 54, since the first diameter Ad2 is less than or equal to the distal diameter Bd2.

And then, the strictly speaking insertion begins. The contact portion 52 penetrates into the housing 14, which causes a radial separation of the distal ends 38 of the strips 26. This radial separation is limited by the action of the contention member 28. During the insertion, the contention member 28 expands, while applying a centripetal pressure on the strips 26. This pressure contributes to flattening the radially internal faces 42 of the strips 26 onto the contact portion 52 of the insertable portion 12.

When the contact portion 52 is totally inserted into the housing 14, the distal opening 40 of the housing is axially located at the proximal end 60 of the contact portion. The distal opening 40 then has an opening having the second diameter Ad2' (FIG. 3). It is understood that the second diameter Ad2' is substantially equal to the proximal diameter Bd1.

The electrical contact is also very good on the side of the bottom of the housing 14, since the opening diameter Ad1 is less than or equal to the distal diameter Bd2.

In the inserted position illustrated in FIG. 3, the strips 26 are perfectly flattened onto the contact portion 52, of which they fit the radially external surface 58, advantageously from the distal end 62 as far as the proximal end 60 of the contact portion. The electrical contact is excellent.

During the insertion, the finger 70 of the first electrical insulator 16 penetrates into the housing 78 of the second electrical insulator 18, so that the electrical insulators 16, 18 are not an obstacle to the insertion.

In the inserted position (FIG. 3), the electrical connector 1 has great mechanical stability by the structure of the strips 26 and by the action of the contention member 28. Additionally, the insertion of the male contact 5 into the female contact 10 remains very easy because of the flexibility of the strips 26 and of the elasticity of the contention member 28.

The electrical connector 1 is de facto extremely performing, both as regards the ease of insertion and the mechanical stability both instantaneous and overtime.

Because of its relatively simple structure, without any interface, the electrical connector 1 has a moderate manufacturing cost.

Finally, by means of the electrical insulators 16, 18, the operator is protected during the handling of the electrical connector 1.

The contention member 28 advantageously consist of a material having a thermal expansion coefficient less than that of the strips 26 of the female contact 10, and less than that of the insertable portion 12 of the male contact 5.

For example, the contention member 28 is in stainless steel, with a thermal expansion coefficient of $14.10^{-6}$ $K^{-1}$.

The strips 26 and the insertable portion 12 are for example in aluminium, with a thermal expansion coefficient of $23.10^{-6}\ K^{-1}$.

Thus, during the heating by the Joule effect of the electrical connector 1, the contention member 28 expands less and exerts a stronger centripetal radial pressure on the strips 26 than in the non-heated condition. This has the consequence of an increase in the pressure exerted by the strips 26 on the insertable portion 12, and an increase in the contact surface area between the strips and the insertable portion. This reduces the contact resistance and causes a decrease in the heating up of the electrical connector 1 during use, as compared with a situation in which the thermal expansion coefficient is significant.

This effect is amplified by the angle a formed by the strips 26 at their base with the insertion axis.

The electrical connector 1 has optimum electrical performances, a great contact surface area with a small electrical resistance, in order to reduce the heating during use with an intense current, with a reasonable insertion force, good resistance to vibrations and small bulkiness relatively to its electrical performances while remaining with simple manufacturing and competitive pricing.

The invention claimed is:

1. An electrical connector comprising a male contact and a female contact movable between a non-inserted position, in which the male contact is away from the female contact, and an inserted position, in which an electrically conductive insertable portion of the male contact is inserted along an insertion axis into a housing defined by the female contact, the female contact comprising:

an electrically conductive body, a plurality of strips protruding axially from the body and angularly distributed around the insertable portion in the inserted position, the strips being electrically conductive and radially flexible, the body and the strips defining said housing, and at least one annular contention member positioned on radially external faces of the strips and adapted for exerting a centripetal radial pressure on the strips in the inserted position, the strips having radially internal faces flattened against the insertable portion in the inserted position, wherein the contention member consists of a material having a thermal expansion coefficient smaller than that of the strips, and less than that of the insertable portion, and wherein the electrical connector further comprises a first electrical insulator adapted for being inserted into the housing of the female contact for protecting a user of the electrical connector, the first insulator comprising:

a ring adapted for capping distal ends of the strips, and ties extending axially from the ring and provided for being inserted between the strips for attaching the first insulator on the female contact.

2. The electrical connector according to claim 1, wherein the strips have distal ends and are bent towards the insertion axis gradually as distal ends are approached.

3. The electrical connector according to claim 1, wherein the strips form at their base an angle with the insertion axis.

4. The electrical connector according to claim 3, wherein the angle is flared.

5. The electrical connector according to claim 1, wherein the insertable portion comprises at least one contact portion on which the strips are flattened in the inserted position, the contact portion including a proximal end having a proximal diameter, the strips defining a distal opening of the housing, the distal opening having a first diameter in the non-inserted position, and a second diameter greater in the inserted position, the first diameter being strictly smaller than the proximal diameter, and the second diameter being equal to the proximal diameter.

6. The electrical connector according to claim 5, wherein the contact portion includes a distal end having a distal diameter, the strips defining a bottom of the housing, the bottom having an opening diameter less than or equal to the distal diameter.

7. The electrical connector according to claim 6, wherein the opening diameter is less than the distal diameter.

8. The electrical connector according to claim 5, wherein the first diameter is less than or equal to the distal diameter, the insertable portion further comprising a distal portion radially thinner than the distal diameter so as to be introduced into the opening of the housing.

9. The electrical connector according to claim 8, wherein the first diameter is less than the distal diameter.

10. The electrical connector according to claim 5, wherein the contact portion includes a radially external surface either cylindrical or frustoconical.

11. The electrical connector according to claim 1, wherein the contention member comprises a curved strip with a « C » shape.

12. The electrical connector according to claim 11, wherein the strip with a "C" shape passes in circumferential grooves formed by the radially external faces of the strips.

13. The electrical connector according to claim 1, wherein the first insulator further comprises:

a base located axially opposite to the ring, and a finger extending axially from the base toward the ring, the finger being located at the center of the housing when viewed along the insertion axis.

14. The electrical connector according to claim 13, wherein each tie forms a bar attached on the base and oriented axially.

15. The electrical connector according to claim 1, further comprising a second electrical insulator adapted for covering a distal end of the insertable portion, the second electrical insulator being adapted for being attached on this distal end.

16. The electrical connector according to claim 15, wherein the second electrical insulator is adapted for being attached on the distal end by insertion of a rod of the second insulator along the insertion axis in the insertable portion.

* * * * *